US006434964B1

(12) United States Patent
Tomiyama et al.

(10) Patent No.: US 6,434,964 B1
(45) Date of Patent: Aug. 20, 2002

(54) ICE-MAKING MACHINE AND ICE-MAKING METHOD

(75) Inventors: Yasushi Tomiyama; Akito Machida, both of Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/783,530

(22) Filed: Feb. 15, 2001

(51) Int. Cl.[7] ..... F25C 1/14
(52) U.S. Cl. ..... 62/354
(58) Field of Search ..... 62/354

(56) References Cited

U.S. PATENT DOCUMENTS 5,363,660 A * 11/1994 Li et al. ..... 62/354
5,385,645 A * 1/1995 Li ..... 159/13.2
5,513,698 A * 5/1996 O'Hanlon ..... 165/109.1
5,597,036 A * 1/1997 O'Hanlon ..... 165/94
5,953,924 A * 9/1999 Li et al. ..... 165/109.1
5,971,061 A * 10/1999 Li ..... 165/109.1

FOREIGN PATENT DOCUMENTS

JP 9-501225 2/1997

* cited by examiner

*Primary Examiner*—William E. Tapolcai
(74) *Attorney, Agent, or Firm*—Crowell & Moring LLP

(57) ABSTRACT

The object of the invention is to provide an ice-making machine having an eccentric driving means and features of reduced wear and tear due to the movement of rotating rods, the machine being composed so that a plurality of heat transfer pipes 3 and rotating rods 4 which rotate inside the heat transfer pipes 3 are disposed in a shell 2, liquid to be cooled is supplied to the inside and refrigerant to the outside of the heat transfer pipes 3 respectively, the liquid to be cooled is cooled so as to form ice crystal on the inside surfaces of the heat transfer pipes 3, the ice is scraped by the rotating rods 4 and taken out as ice grains together with the liquid to be cooled, the rotating rods 4 being passed through the holes 5*a* provided on a driving plate 5 which is connected with a driving shaft 13 by the medium of a eccentric drive means 13*a* or 17 to be revolved to the effect that the rods 4 are revolved by the revolving of the driving plate 5 while rotating in the holes 5*a*.

8 Claims, 17 Drawing Sheets

ICE-MAKING MACHINE AND ICE-MAKING METHOD

BACKGROUND OF THE INVENTION

1. Field of the Invention

The present invention relates to an ice-making machine and an ice-making method, specifically a machine and a method for producing ice-slurry by forming a frozen layer inside a plurality of heat transfer pipes by allowing a liquid to be cooled to flow inside the pipes and a refrigerant liquid outside the pipes and scraping the frozen layer with a rotating rod rotating inside the pipes.

2. Description of the Related Art

Heretofore, an ice-making machine that is known as this kind is a machine for producing ice-slurry by forming a frozen layer inside a plurality of heat transfer pipes by allowing a liquid to be cooled to flow inside the pipes and a refrigerant liquid outside the pipes and scraping the frozen layer with a rotating rod (agitating bar) rotating inside the pipes (see Unexamined Published International Patent Application No. 9-501225). In the apparatus disclosed in the above Patent Application, a refrigerant is supplied to the outside of heat transfer pipes disposed upright and a liquid is supplied from the upper end of the heat transfer pipe to be frozen to form ice crystals in the popes. The ice crystals are mechanically removed by scraping the crystals with rotating rods rotating in the pipes. The scraped ice becomes slurry, which is re-circulated.

However, the ice-making machine of the prior art mentioned above has problems cited below. As a crank mechanism is provided for each of the agitating rod which revolves while rotating in each heat transfer pipe to scrape the ice crystal, the driving mechanism of the rods is complicated and a large number of parts are required.

Further, as the rotating rod is made of stainless steel, abrasion occurs due to the rubbing of the rod against the heat transfer pipe made of metal. As a result, the rotating rod and heat transfer pipe are damaged, and the attrition is further advanced by the tore-off matter due to the abrasion, the tore-off matter acting as abrasive.

Still further, as the diameter of the rotating rod is small compared with the inside diameter of the heat transfer pipe, the rotation speed of the rotating rod is relatively fast and the abrasion of the sliding face becomes severe.

Yet further, there are problems that, as the ice-making machine is of open type and the intrusion of air is premised, there occur air trapping into the liquid to be cooled inducing generation of bubbles, deterioration of the liquid, oxidation of the piping, dysfunction of pumping and transferring in the piping due to the trapped air as the water-with-ice mixed with air is to be transferred to a load side, leakage of sealing, and decreasing of heat transfer ability of the heat exchanger.

SUMMARY OF THE INVENTION

The present invention is made in the light of the problems mentioned above. An object of the invention is to provide an ice-making machine having an eccentric driving means, in which abrasion by the motion of a rotating rod is reduced and air is not induced.

Another object of the invention is to provide an ice-making method in which the detection of the state of freezing at the start and at the end of operation and in the heat transfer pipes is performed.

To attain the objects, an ice-making machine according to the present invention is provided with a plurality of heat transfer pipes and rotating rods each of which rotates in each of the heat transfer pipes disposed inside a shell, in which a liquid to be cooled is supplied to inside and a refrigerant liquid to outside the heat transfer pipes, ice crystals are formed on the inside surfaces of the heat transfer pipes through the cooling of the liquid to be cooled, and the ice crystals are scraped off with the rotating rods and taken out together with the liquid to be cooled, wherein the rotating rods which pass through the holes, the holes being larger in diameter than that of the rotating rods, of a driving plate connected with a revolving eccentric driving means provided on a driving shaft, revolve while rotating in the heat transfer pipes.

According to the above cited invention, as the rotating rods passing through the holes formed in a driving plate are driven by the driving plate revolved by the medium of an eccentric driving means provided on a driving shaft by means of the holes to revolve and at the same time to rotate, all of the rotating rods are driven by a single eccentric driving means in synchronization with each other. Therefore, an ice-making machine of closed type with a simplified eccentric driving means and a small number of constituent parts is obtained, leading to easy maintenance and operation free from the intrusion of air.

A simple mechanism of the eccentric driving means can be established by providing the driving shaft with an eccentric cam or a crank.

Further, by configuring the rotation rod as a metal rod provided with a plastic layer on the surface, preferably a plastic layer such as fluororesin having good sliding property with small friction resistance, metal-to metal contact is avoided and worn-off metal grains are embedded in the plastic layer, and less abrasion of the inside surface of the heat transfer pipe is effected.

Still further, according to the present invention, by attaching heat-insulating material on pipe end plates provided on both ends of a shell, the growth of ice frozen on the end plates inside headers is prevented.

Yet further, each of the rotating rods is supported at the head part formed at its upper end by a fixed plate attached to the shell, and a taper face formed on the lower periphery of the head part of each of the rotating rods sits on the taper face formed on the periphery of each of the penetrating holes on the fixed plate.

According to the invention cited above, as the taper face of the head part of the rotating rod contacts with the taper face of the hole of the fixed plate to slide on it, friction face of rotation becomes small and deformation and damage due to wear can be reduced.

Further, according to the present invention, the head part and lower end part of each of the rotating rods protrude into headers disposed at both end sides where the liquid to be cooled passes through and the liquid to be cooled passing through the headers is agitated by the revolving motion of the head part and lower end part of each of the rotating rods. Accordingly, the stagnation of ice in the headers is prevented by the stirring action of the head parts and lower end parts of the rotating rods.

Further, the present invention is characterized in that additional holes for the mixture of the liquid to be cooled and ice to flow through are formed on the driving plate and fixed plate. Therefore, the stagnation of ice grains between the plates is prevented. As the ice grains formed also flow through the additional holes in addition through crescent holes formed between the holes on the driving plate, fixed plate, and rotating rods, the biting of ice grains between the rotation sliding surfaces is reduced. Therefore, the erosion of the sliding faces of the holes and the rotating rods is suppressed.

Further, the present invention is able to be composed so that the rotating rods automatically move to the center side of the heat transfer pipes when frozen layer grows without being scraped off in the heat transfer pipes, by providing a slide cam for adjusting the amount of eccentricity between the driving plate and the driving shaft.

Further, in the present invention, it is possible to remove iron rust contained in the liquid to be cooled by allowing the rust to adhere to magnets provided on the inside periphery of the headers.

It is preferable to compose the present invention so that a shell is disposed horizontally, both ends of rotating rods are supported by driving plates, a balance weight driven by the driving shaft is disposed in the center part of the shell, and heat transfer pipes are immersed in refrigerant liquid filled in the shell. According to the invention, an ice-making machine without intrusion of air, generation of bubbles, and deterioration of brine because of its full-filled horizontal type, is constructed.

Further, an ice-making method according to the present invention is a method in which a liquid to be cooled is supplied to inside and a refrigerant liquid to outside the heat transfer pipes disposed in a shell ice crystals are formed on the inside surfaces of the heat transfer pipes through the cooling down of the liquid to be cooled, and the ice crystals are scraped off with the rotating rods and taken out together with the liquid to be cooled, wherein the liquid to be cooled and the refrigerant are flowed inside and outside the heat transfer pipes respectively; a driving motor is started to rotate with slow speed to rotate the rotating rods when the evaporation temperature of the refrigerant has become 0° C. or below; when the freezing in the heat transfer pipes has advanced and the load for the driving motor has become larger than a certain value, the supply of the refrigerant is stopped and refrigerant gas is introduced from a refrigerator into the evaporating part of the shell to raise the evaporating temperature therein; after the evaporating temperature has risen to the freezing temperature or above of the liquid to be cooled, the operation of the refrigerator is stopped; and the operation of the refrigerator is restarted at the time the load for the driving motor recovered the initial value.

According to the above cited invention, as the driving motor is started with low rotation speed at first when the evaporating temperature of the refrigerant is 0° C. or below and the rotation speed of the driving motor is increased at the time the freezing in the heat transfer pipes has advanced, the plastic layers formed on the surface of the rotating rods are prevented from melting in the early stages of the operation when the temperature of the rotating rods is high by rotating them with low speed, and the supply of the refrigerant and the liquid to be cooled is able to be controlled while detecting the degree of freeze in the course of freezing, ice grains are produced by automatic and safe operation.

Further, the present invention is characterized in that, when stopping the operation of the ice-making machine, at first the operation of the refrigerator is stopped, then the driving motor is stopped at the time the saturation temperature corresponding to the pressure at the evaporating part of the refrigerant has risen to equal or above the freezing temperature of the liquid to be cooled, and the supply of the liquid to be cooled is stopped at last.

According to the invention cited above, as the driving motor is stopped at the time the saturation temperature has risen to the freezing temperature or higher and the supply of the liquid to be cooled is ceased at last, automatic and safe operation is possible.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
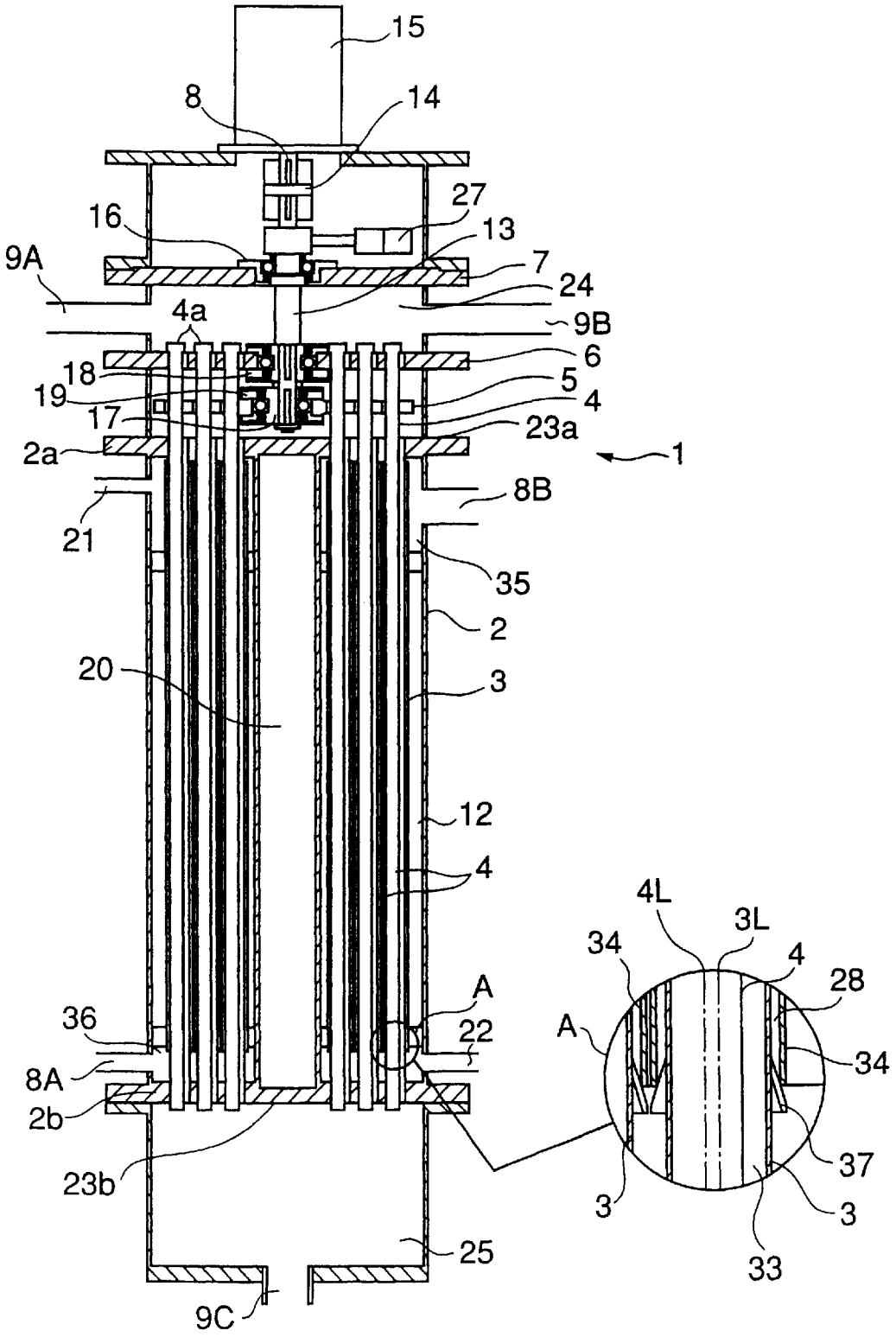
FIG. 1 is a longitudinal sectional view showing a first embodiment of an ice-making machine according to the present invention.

FIG. 1 shows an ice-making machine of a first embodiment, which is an example of vertical dry type ice-making machine according to the present invention.

An ice-making machine 1 comprises a shell 2 which is an outermost pipe, a plurality of heat transfer pipes 3 disposed parallel to each other in the shell 2, and a plurality of rotating rods 4 each of which is disposed in each of the heat transfer pipes with play between them. The heat transfer pipes are fixed to the shell 2 by way of a pipe end plate 2*a* and 2*b*. The upper part of each of the rotating rods 4 protrudes from the pipe end plate 2*a* at the upper part of the shell 2, the head part 4*a* at the upper end of the rotating rod 4 being supported by a fixed plate 6, the lower end part being inserted in the pipe end plate 2*b* located at the bottom of the shell 2. A driving plate 5 is disposed between the fixed plate 6 and the pipe end plate 2*a* at the upper part of the rotating rods 4.

Figure 8A:
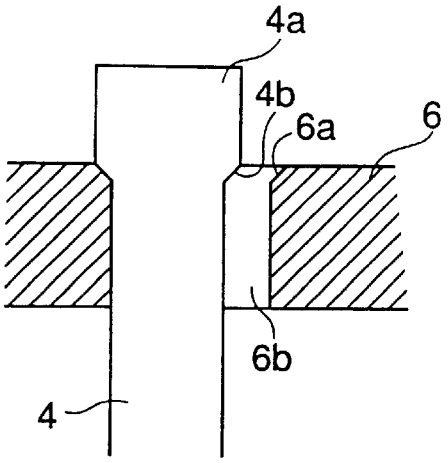
FIG. 8 is a partial longitudinal sectional view of the rotation sliding part of the rotating rod of an embodiment according to the present invention.
Figure 8B:
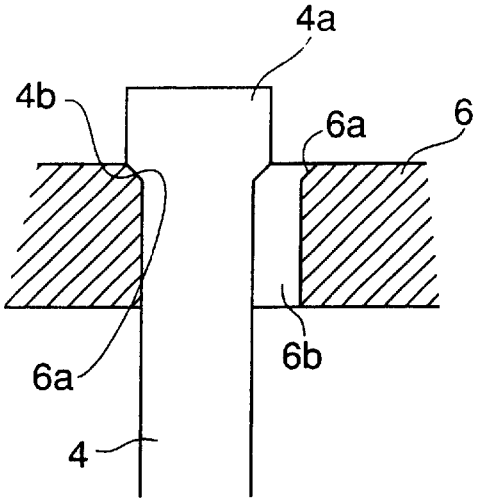

As shown in FIG. 8, the rotating rod 4 has a head part 4*a* of which the periphery of the lower part is formed to a taper face 4*b*, and the taper face 4*b* sits on a taper face 6*a* formed on the periphery of a hole 6*b* on the fixed plate 6. By this configuration, the friction face between the taper face 4*b* and 6*a* is small and damage and deformation due to wear is reduced. Even when the taper faces have worn as shown in FIG. 8(*b*), the head part 4*a* becomes small but it causes no trouble for the rotation of the rod 4.

Figure 9A:
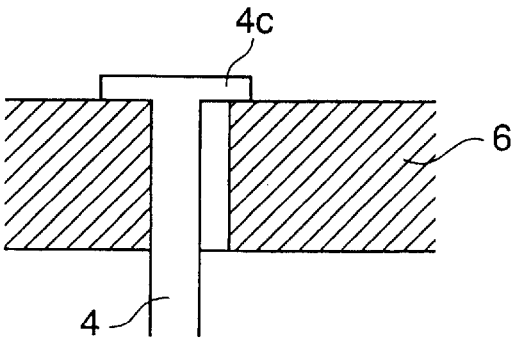
FIG. 9 is a partial longitudinal sectional view of the rotation sliding part of the rotating rod with flat head part.
Figure 9B:
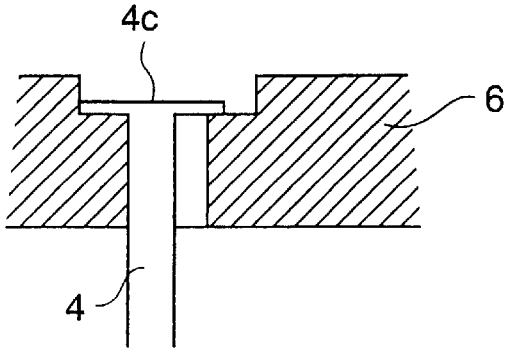

On the contrary, by the configuration in which a flat head part 4*c* is formed at the top end of the rotating rod 4 as shown in FIG. 9(*a*), damage and deformation of the flat head part 4*c* and the upper face of the fixed plate 6 is apt to occur due to wear of the sliding faces.

Figure 4A:
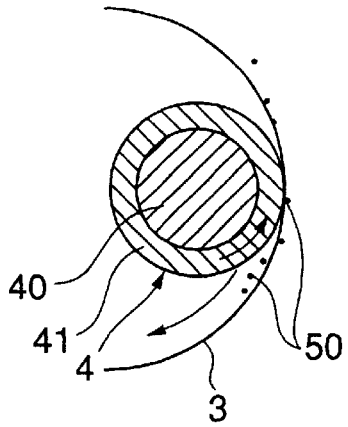
FIG. 4(*a*) is a transverse sectional view of a rotating rod of an embodiment according to the present invention, FIG. 4(*b*) is a transverse sectional view of a rotating rod of prior art.
Figure 4B:
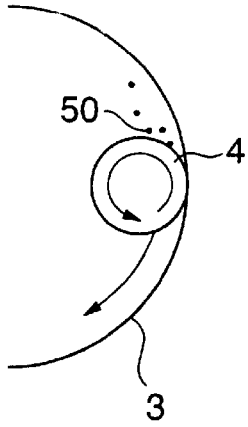
Fig.4(b) PRIOR ART

As shown in FIG. 4(*a*), the rotating rod 4 is a metal rod covered with a plastic layer 41, and its diameter is preferable to be about 26 mm (in the case the inside diameter of the heat transfer pipe is 35 mm).

Again in FIG. 1, a driving shaft 13 is connected to the driving plate 5 and the fixed plate 6 at their center parts via a sealed bearing assembly 18 and 19 respectively. The upper part of the driving shaft 13 is supported by a sealed bearing assembly 16 at the center part of a fixed cover 7 and connected to the motor shaft 8 of a driving motor 15 via a coupling 14. At the upper part of the driving shaft 13 is attached a balance weight 27 to apply inertia force to the driving shaft. An eccentric cam 17, which is an eccentric driving means, is mounted at the connecting part of the driving shaft with the driving plate 5.

A header 24 which is a space between the fixed plate 6 and the fixed cover 7 is provided with inlet (outlet) ports 9A and 9B. A header 25 which is a space formed under the pipe endplate 2*b* fixed to the lower end of the shell 2 is provided with outlet (inlet) ports 9C. A header 36 located at the lower part of a space 12 which is to be filled with refrigerant between the pipe end plates 2*a* and 2*b* is provided with an inlet port 8A from which the refrigerant is supplied between the heat transfer pipes 3 and heat transfer promoting pipes 34.

At a refrigerant gas header 35 located at the upper part of the space 12 is provided a refrigerant gas outlet port 8B for exhausting the refrigerant gas gasified after cooling the liquid to be cooled in the heat transfer pipes 3. The refrigerant liquid header 36 provided under the shell is provided with an oil return outlet port 22. Heat insulating layers 23*a* and 23*b* are formed on the pipe end plates 2*a* and 2*b* for thermal insulation between the liquid to be cooled and refrigerant (described later with reference to FIG. 17).

The space 12 and a dead space 20 at the center zone of the shell 2 are provided for reducing the excess quantity of the refrigerant by reducing the space inside the shell 2.

As shown in an enlarged detail A of FIG. 1, the liquid to be cooled flows through the passage 33 which is a space formed between the heat transfer pipe 3 and the rotating rod 4, the center line 3L of the heat transfer pipe 3 going off the center line of the rotating rod 4. The refrigerant liquid flows into a refrigerant passage 28 formed between the heat transfer pipe 3 and the heat transfer promoting pipe 34 provided around the outside perimeter of the heat transfer pipe 3 via an orifice 37. The refrigerant liquid is supplied evenly around the outer perimeters of a plurality of the heat transfer pipes 3 by the throttling action of the orifices 37.

The refrigerant liquid cools a plurality of the heat transfer pipes 3 from outside to freeze the liquid flowing in the heat transfer pipes 3 to their inside faces by depriving the latent heat of the liquid to be cooled. The ice generated by the freezing is scraped off with the rotating rods 4 to be reserved in the headers 24 and 25 for retaining the mixture of liquid to be cooled and ice, from where the mixture flows out through the outlet port 9A, 9B or 9C. By the way, the liquid to be cooled inside the heat transfer pipes 3 may be flowed upward or downward. Therefore, when the flow direction is upward the inlet port of the liquid to be cooled is 9C and the outlet ports are 9A and 9B, and when the flow direction is downward the inlet ports of the liquid to be cooled are ports 9A and 9B and the outlet port is 9C.

Figure 3:
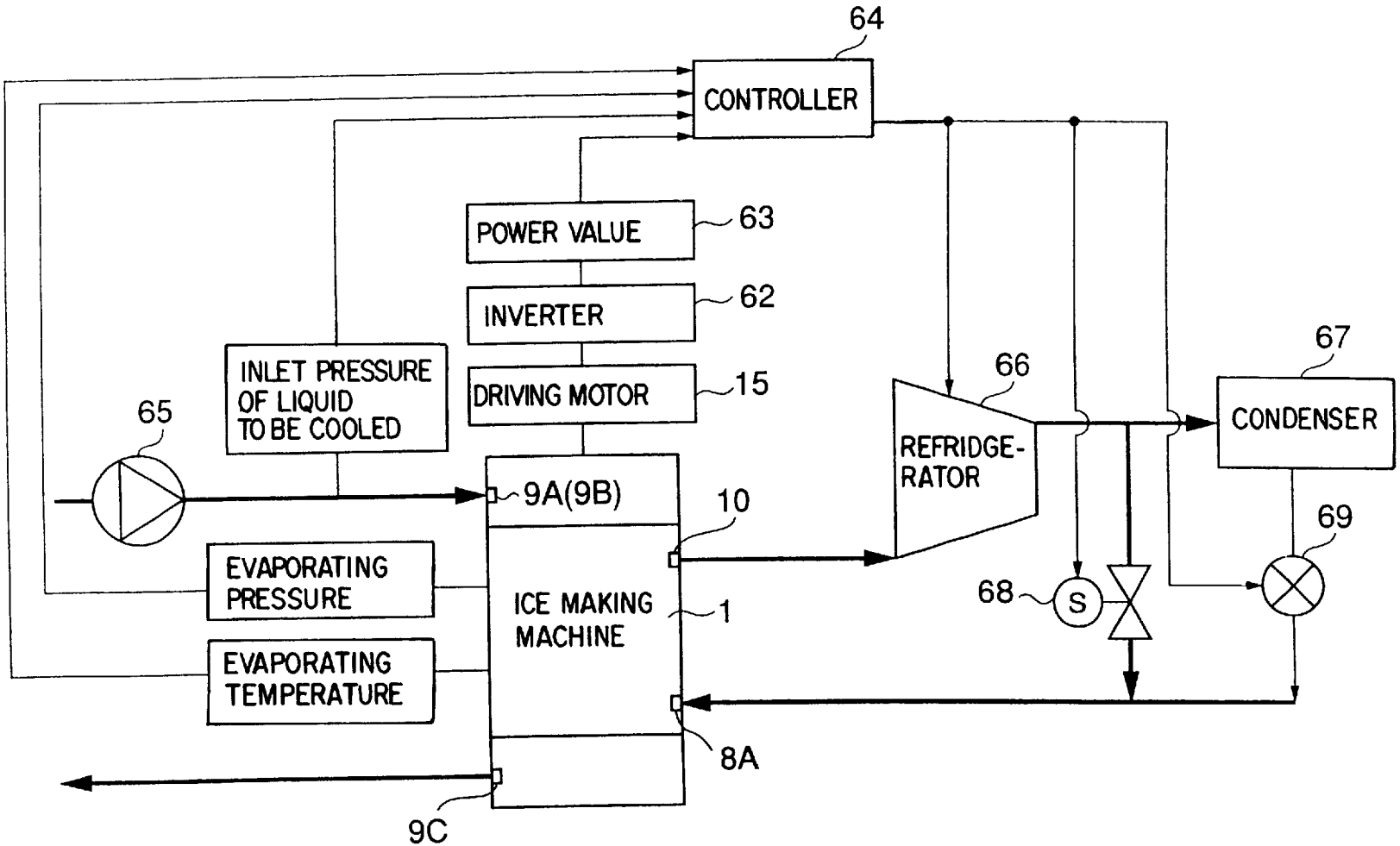
FIG. 3 is an example of flow-sheet of an ice-making machine of said embodiments according to the present invention.

FIG. 3 is an example of flow-sheet of the ice-making machine. In the drawing, reference number 62 is an inverter for varying the rotation speed of the driving motor 15. The value of the power 63 supplied by the inverter 62 is input to a controller 64. The liquid to be cooled is supplied to the ice-making machine 1 from a supply pump 65. The refrigerant gas from the ice-making machine 1 is compressed by the compressor of a refrigerator 66, then condensed in a condenser 67, and the condensed refrigerant is supplied to the ice-making machine 1 via a refrigerant supplying valve 69. Reference numeral 68 is a magnetic valve.

The refrigerant gas taken out from a refrigerant gas outlet port 10 of the ice-making machine 1 is sent to the refrigerator 66, cooled in the condenser 67 to be reduced to liquid refrigerant, and sent to the ice-making machine by way of the refrigerant supply valve 69. The liquid to be cooled is sent to the inlet port 9A or 9B of the ice-making machine by a pump 65, the pressure Pin of the liquid to be cooled at the inlet being measured. The controller 64 controls the opening and closing of the magnetic valve 68 and refrigerant supply valve 69 based on the measured evaporation pressure Pe and Te of the refrigerant liquid.

Hereinbelow, the operation of the ice-making machine 1 is explained with reference to FIG. 3.

(a) Start of Operation:

At first, the liquid to be cooled is flown to the ice-making machine, and the refrigerator 66 is operated to send the refrigerant to cool down the liquid to be cooled. When the evaporating temperature of the refrigerant in the ice-making machine reaches 0° C. or below, the low speed operation of the driving motor 15 is started. This is necessary for preventing the melting of the plastic material covering the rotation rods because if the driving part is rotated with high speed while the surface temperature of the rotating rods is high, the plastic material may melts, and for ensuring incipient running-in.

When the evaporating temperature of the refrigerant in the ice-making machine 1 has become equal to or below the freezing temperature of the liquid to be cooled, the driving motor 15 is sped up to the predetermined rotation speed.

(b) Detection of Freezing Inside the Heat Transfer Pipes and Unfreezing:

When the freezing inside the heat transfer pipes 3 advances, the load for the driving motor increases due to the increased resistance to the movement of the rotating rods 4. When the value of the power 63 supplied by the inverter 62 to the driving motor 15 has become a certain value or larger, the refrigerant supply valve 69 is controlled according to the signal from the controller 64 to stop the supply of the refrigerant, and the magnetic valve 68 is opened to bypass the refrigerant gas from the refrigerator 66 to the refrigerant header 36 and evaporating part of the ice-making machine 1 for raising the evaporation temperature Te of the refrigerant. After the temperature Te has risen to the freezing temperature or above of the liquid to be cooled, the operation of the refrigerator 66 is stopped by the signal from the controller 64.

By raising the evaporating temperature Te above the freezing temperature of the liquid to be cooled, the frozen parts are heated from outside the heat transfer pipes 3 to be melted and exfoliated. When the initial value of power 63 supplied to the driving motor is recovered, the operation of the refrigerator 66 is restarted.

Figure 22A:
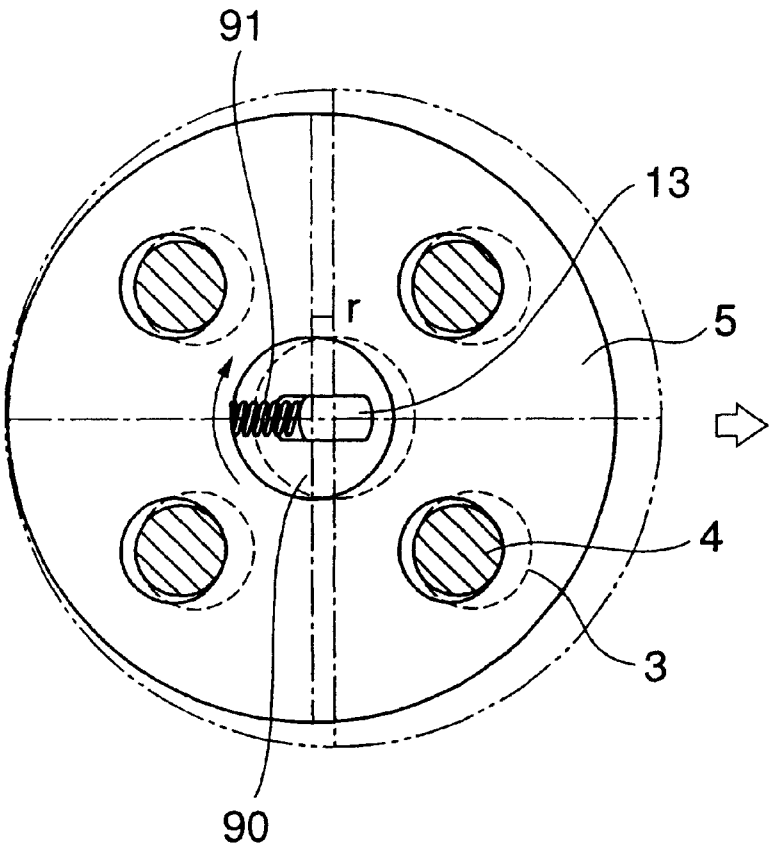
FIG. 22 are transverse sectional views showing the mechanism for adjusting the amount of eccentricity according to the present invention.
Figure 22B:
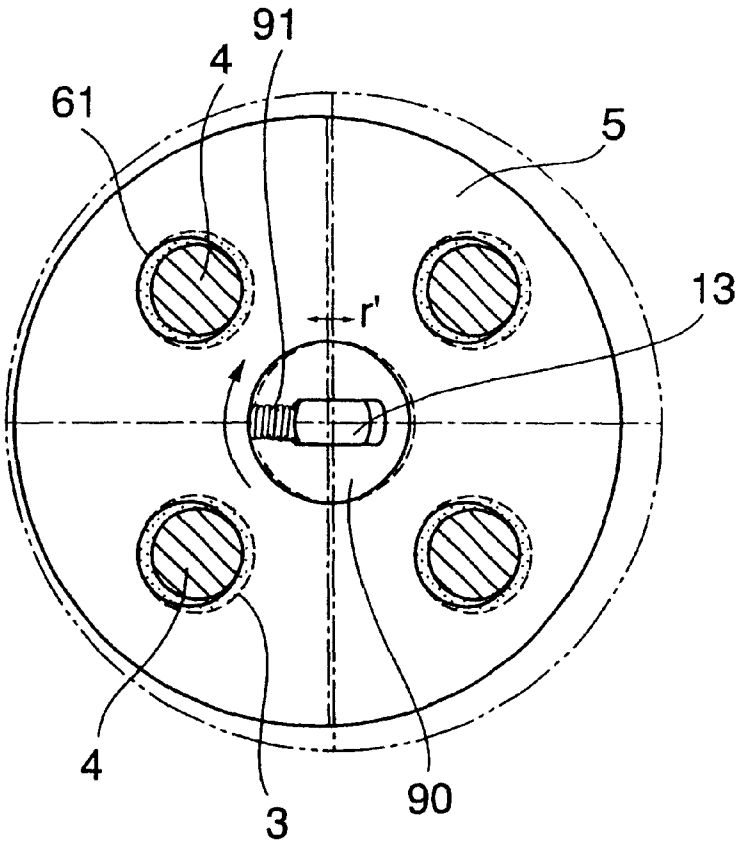

When the freezing inside the heat transfer pipes 3 has advanced, the amount of the eccentricity defined by a slide cam 90 mounted in the driving plate 5 decreases and the rotating rods 4 move toward the center side of the heat transfer pipes 4 as the freezing proceeds (see FIG. 22).

As the frozen layers in the heat transfer pipes grow, the evaporating temperature Te and pressure Pe decrease, for the amount of heat exchange decreases. Further, the inlet pressure Pe of the liquid to be cooled increases, for the passages of the liquid to be cooled become choked as the frozen layers grow. When the inlet pressure Pin of the liquid to be cooled rises to a certain value or above, the refrigerant supply valve 69 is closed to stop the supply of the refrigerant and the magnetic valve 68 is opened to bypass the high pressure refrigerant gas from the refrigerator 66 to the evaporating part of the ice-making machine 1 to raise the evaporating temperature of the refrigerant above the freezing temperature of the liquid to be cooled according to a signal from the controller 64. Then the operation of the refrigerator 66 is stopped.

By raising the evaporating temperature Te above the freezing temperature, the frozen parts are heated from outside the heat transfer pipes to be melted and exfoliated. When the initial value of power 63 supplied to the driving motor is recovered, the operation of the refrigerator 66 is restarted.

(c) Stopping of Operation:

At first, the operation of the refrigerator 66 is stopped. Then, the driving motor 15 is stopped at the time the saturation temperature corresponding to the pressure Pe at the evaporating part in the ice-making machine 1 becomes equal to or above the freezing temperature of the liquid to be cooled. It is suitable to introduce high pressure refrigerant gas to the evaporating part and raise the pressure in it for expediting this operation. After the driving motor 15 is stopped, the pump 65 is brought into a standstill to stop the supply of the liquid to be cooled.

Figure 5A:
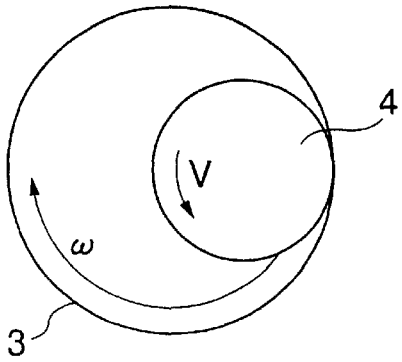
FIG. 5(*a*) is a transverse sectional view for explaining the working of the rotating rod of an embodiment according to the present invention, FIG. 5(*b*) is a transverse sectional view for explaining the action of the rotating rod of prior art.
Figure 5B:
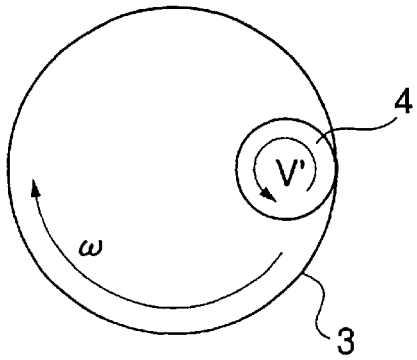
Fig.5(b) PRIOR ART

FIG. 5 depicts the relation between the heat transfer rod and rotating rod in schematic form; (a) shows the case of the present invention, (b) shows the case of an ice-making machine of prior art for comparison. In FIG. 5(*a*) which shows an embodiment of the present invention, the diameter of the rotating rod is 26 mm(in the case the inside diameter of the heat transfer pipe is 35 mm) compared to 9 mm (in the case the inside diameter of the heat transfer pipe is 29~38 mm) of the rotating rod of the prior art shown in FIG. 5(*b*).

As the diameter of the rotating rod of the present invention is larger than that of the prior art, the rotation speed V of the rotating rod of the present invention is smaller than the rotation speed V' of the rotating rod of the prior art. So the wear due to rotation sliding is relatively little in the case of the present invention compared with the case of the prior art. Further, in the case of the present invention, as the cross-sectional area of the flow passage of the liquid to be cooled inside the heat transfer pipe is smaller, the flow velocity is larger which leads to increased heat transfer and easy removal of soil. Still further, by enlarging the diameter of the rotating rod, the stiffness of the rotating rod increased and the heat capacity of the same becomes large.

The increase of heat capacity contributes together with the plastic layer of which the heat conductivity is small to prevent the decreasing of rotation efficiency due to the action of adhering by freezing between the rotating rod and the inside surface of the heat transfer pipe.

As shown in FIG. 4(*b*), in the case of the rotating rod 4 made of stainless steel, the degree of wear of the inside surface of the heat transfer pipe made of metal by worn-off metal grains 50 is large. As the rotating rod 4 according to the present invention shown in FIG. 4(*b*) is covered with a plastic layer 41, metal-to metal contact is avoided, worn-off metal grains are embedded in the plastic layer, and less abrasion of the inside surface of the heat transfer pipe 3 is effected.

Figure 6:
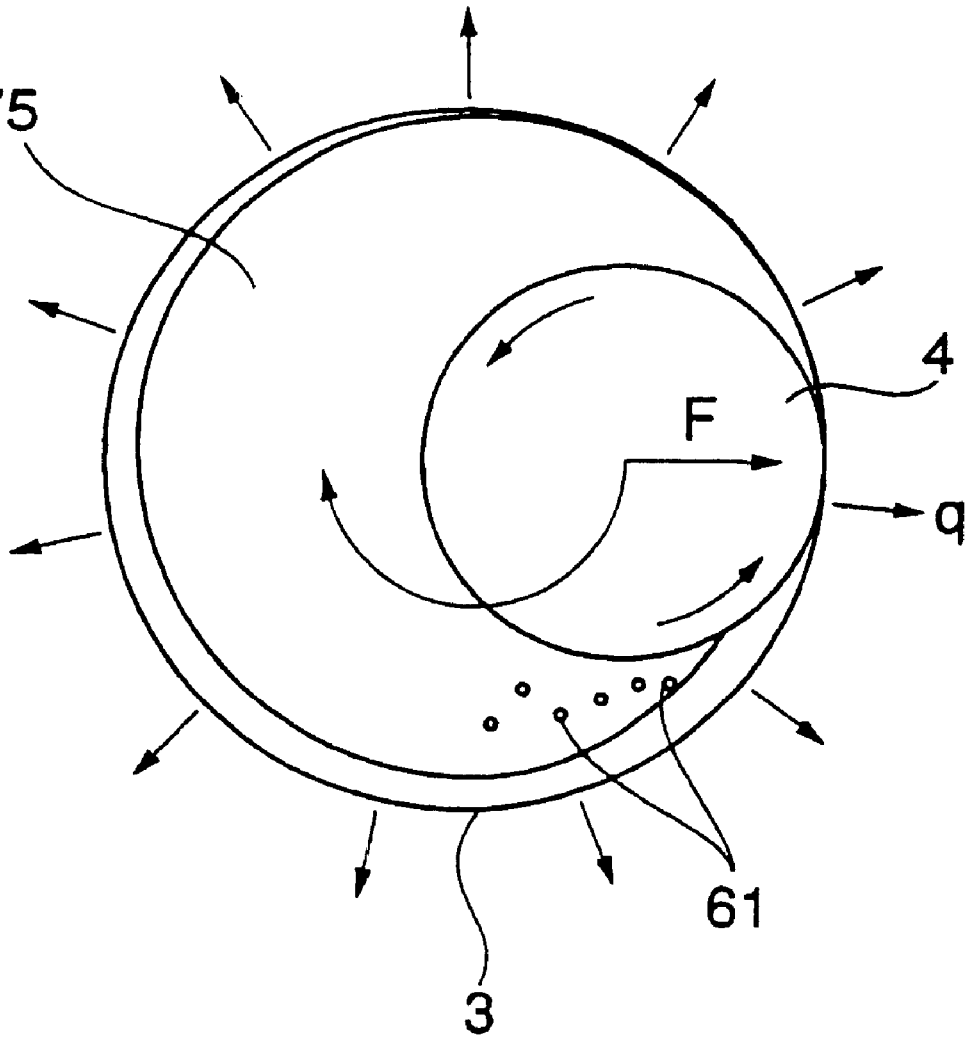
FIG. 6 is a transverse sectional view for explaining the relation between the efficacy in making ice and the centrifugal force of the rotating rod.

FIG. 6 shows the relation between ice-making efficacy (heat flux) and the centrifugal force of rotating rod. The liquid to be cooled 75 flowing in the heat transfer pipe 3 is frozen on the inside surface of the heat transfer pipe 3 and grows as ice 61 on the surface. To remove the ice 61 steadily from the inside surface of the heat transfer pipe 3, adequate centrifugal force F of the rotating rod 4 is necessary in accordance with the heat flux q for generating ice. The centrifugal force F of the rotating rod 4 determined by adjusting the weight of the rotating rod 4, the radius and speed of revolution.

Figure 7:
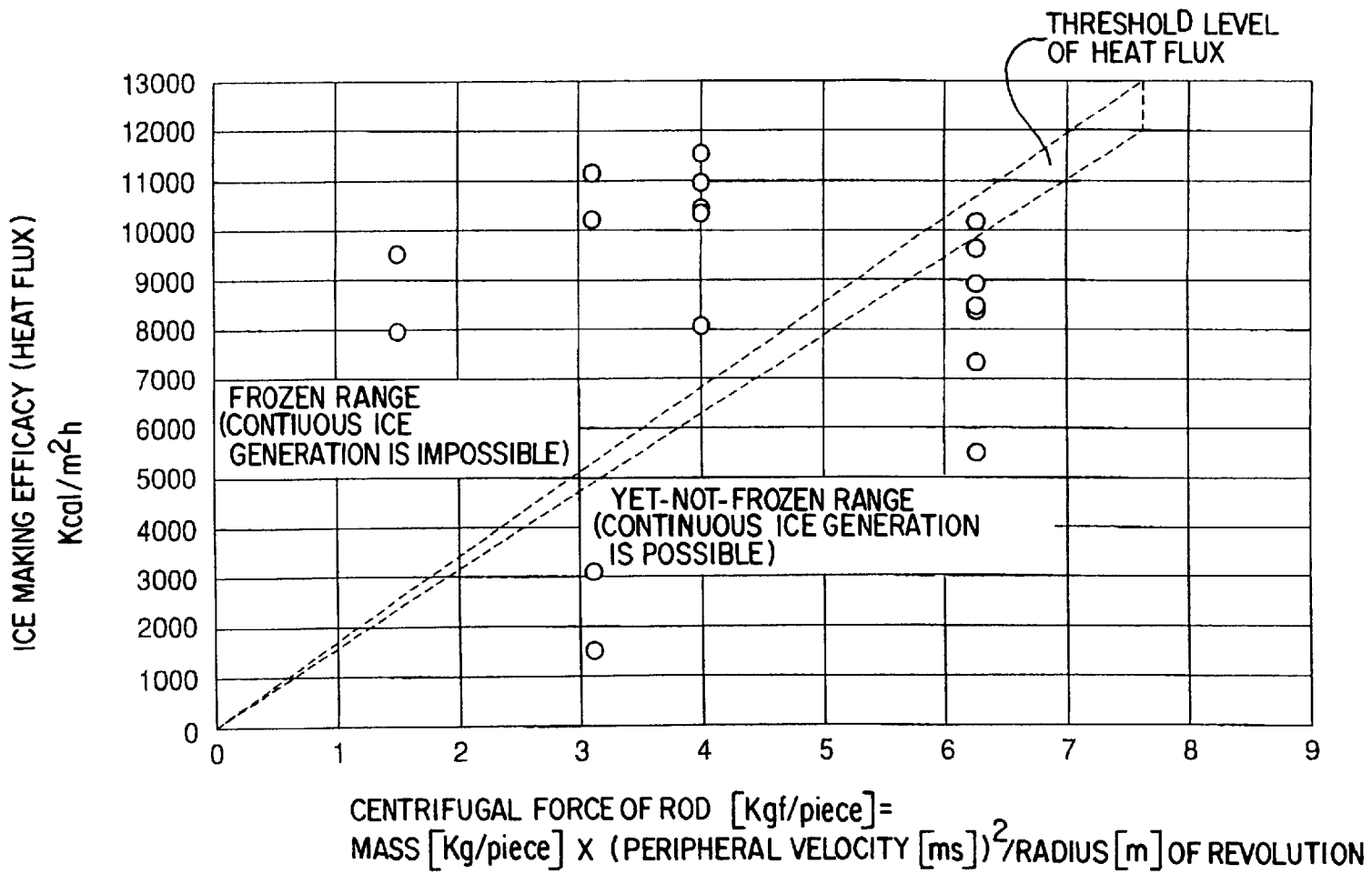
FIG. 7 is a graph showing the relation between the efficacy in making ice and the centrifugal force of the rotating rod.

FIG. 7 is a graph showing the relation between ice-making efficacy (heat flux) and the centrifugal force of rotating rod. From the graph, it is recognized that ice-making efficacy (heat flux) and the centrifugal force of the rotating rod are in a direct proportional relationship. Above the threshold level of heat flux is the frozen range (continuous ice generation is impossible) and below the threshold level is the yet-not-frozen range (continuous freezing is possible). When the heat flux is larger than the threshold level, complete scraping-off of ice by the movement of the rotating rod is not possible, and the freezing inside the heat transfer pipe 3 proceeds.

Figure 10:
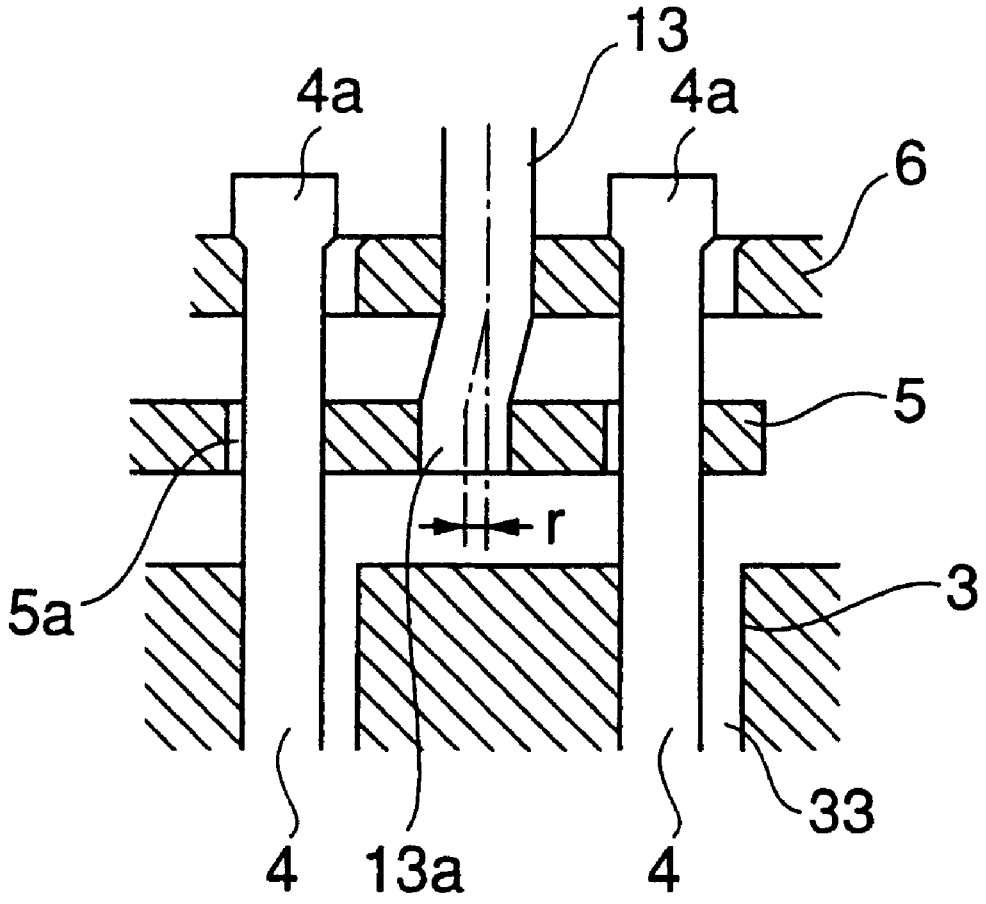
FIG. 10 is a partial longitudinal sectional view explaining the working of the eccentric driving mechanism of an embodiment according to the present invention.
Figures 11A, 11B, 11C:
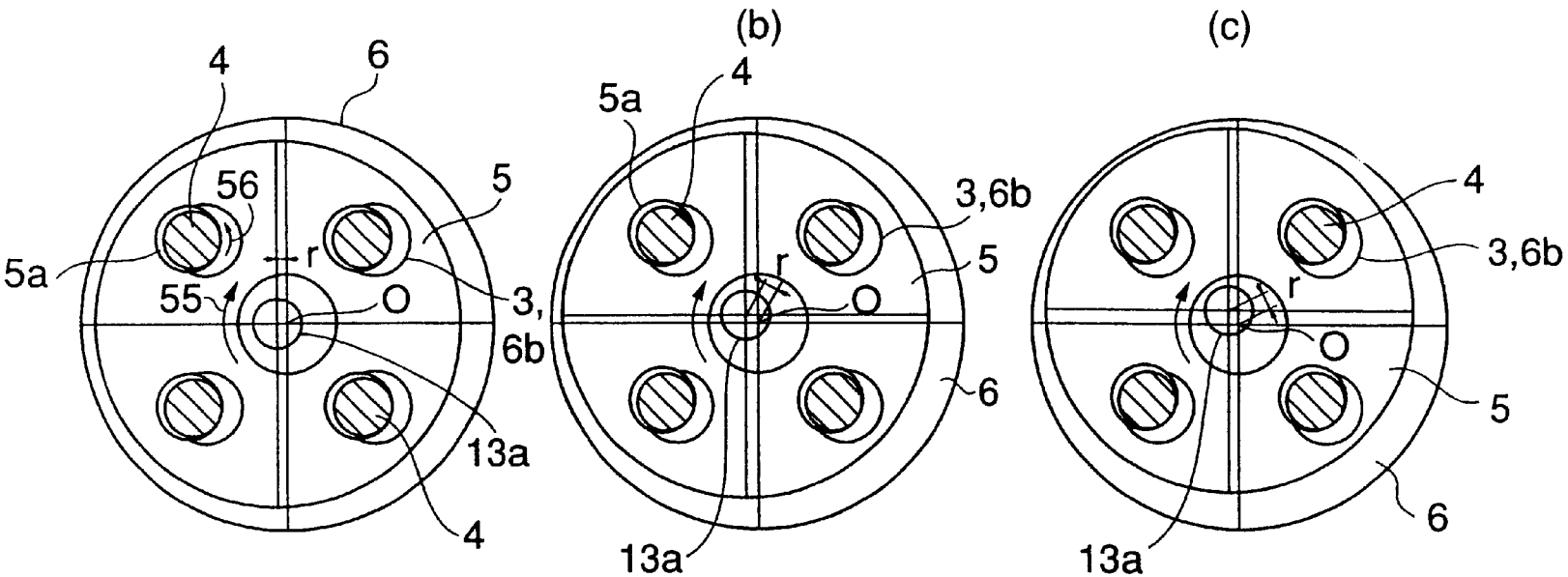
FIG. 11 is a transverse sectional view explaining the working of the eccentric driving mechanism of an embodiment according to the present invention.
Figure 12A:
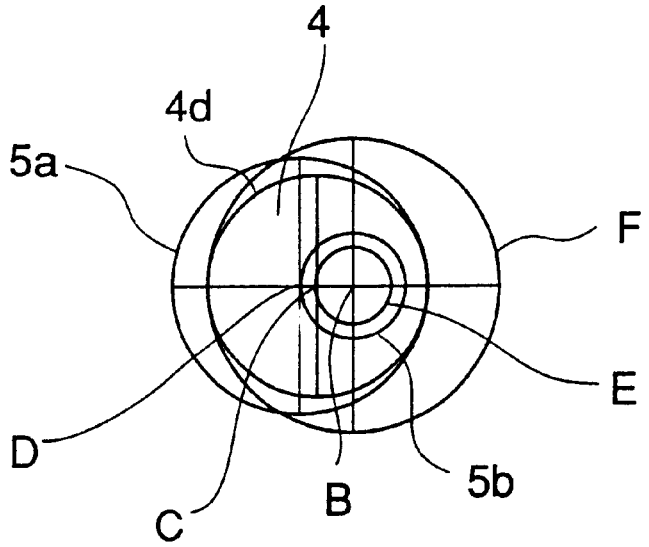
FIG. 12 is a transverse sectional view showing trajectories of the eccentric motion of the rotating rod of an embodiment according to the present invention.
Figure 12B:
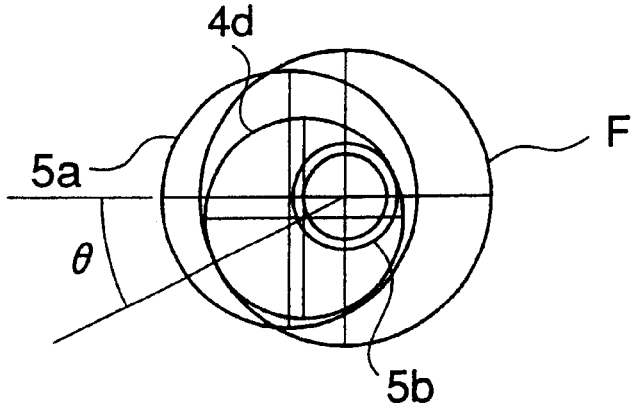
Figure 12C:
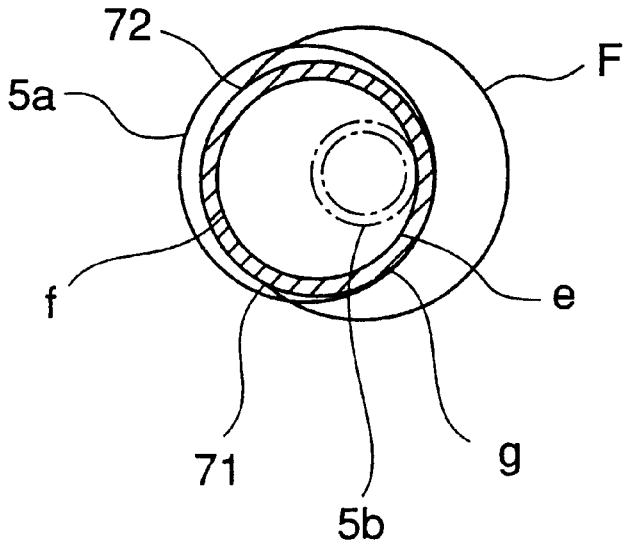

FIGS. 10, 11, and 12 are drawings for explaining the eccentric driving mechanism of the driving plate 5 and rotating rod 4.

In FIG. 10 and FIG. 11, the lower end part of the driving shaft 13 is formed as a crank 13*a* having an offset amount of r from the center O of the driving shaft 13, the crank 13*a* being fit with clearance into the driving plate 5. When the driving shaft 13 rotates in the direction of arrow 55, the driving plate 5 revolves around the center O with a radius of r, at the same time the rotating rod 4 is rotated in the direction of arrow 56 by the friction of contact with the hole 5*a* of the driving plate 5.

That is, each of the rotating rods 4 revolves while rotating itself. As the rotating rod 4 is supported at three points, viz, at the heat transfer pipe 3, driving plate 5, and fixed plate 6, the wobbling or violent movement of the rotating rod 4 is prevented (see FIG. 1).

In FIG. 11 are shown three transverse sectional views for explaining the movement of the driving plate 5 and rotating rod 4. The crank 13*a* is offset by an amount of r from the center. Although in the embodiment of FIG. 1 is shown an example of the case the eccentric cam 17 is fixed to the rotating rod 4, the working of the eccentric cam 17 is the same as that of the crank 13*a*.

In FIG. 12(*a*), reference numeral 5*a* is the hole on the driving plate 5, numeral 5*b* is the revolving diameter of the driving plate 5, numeral 4*d* is the outer diameter of the rotating rod, letter mark B is the center of the heat transfer pipe 3, mark C is the center of the rotating rod 4, mark D is the center of the hole 5*a*, mark E is the revolving diameter of the rotating rod 4, and mark F is the inside diameter of the heat transfer pipe 3. The situation is shown in FIG. 12(*b*), that the rotating rod 4 revolves along the inside perimeter of the heat transfer pipe 3 while rotating itself. In the case the outer diameter 4*d* of the rotating rod 4 is small, the rod 4 revolves with retard of θ in phase.

An example us shown in FIG. 12(*c*), that a sleeve 71 is attached around the rotating rod 4. In the drawing, letter mark e is the contacting point of the rotating rod 4 with sleeve 71, mark f is the contacting point of the heat transfer pipe 3 with the rotating rod 4, and mark g is the contacting point of the sleeve 71 with the hole 5*a* on the driving plate 5. With the sleeve 71, the gap 72 between the sleeve and the rotating rod 4 can accommodate the deviation of location or dimension even if processing accuracy is bad.

Figure 13:
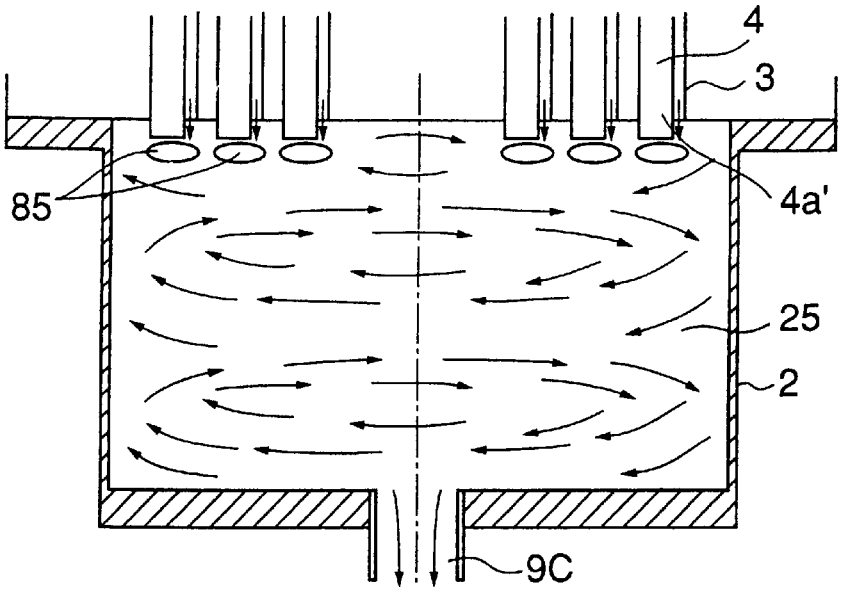
FIG. 13 is a partial longitudinal view showing the circumstance under which the stagnation of ice is prevented in the lower header part of an embodiment according to the present invention.

FIG. 13 shows a configuration for preventing the stagnation of ice in the lower outlet of the ice-making machine 1. The flow velocity in the lower header 25 is fairly slow and the ice apt to stagnate at the portion where the liquid does not flow. By making the tail part 4*a*' of the rotating rod 4 protrude into the header 25, eddy-like flow 85 is generated by the agitating action of the tail part 4*a*', and the ice grains ride on the flow to be prevented from stagnation.

Figure 14:
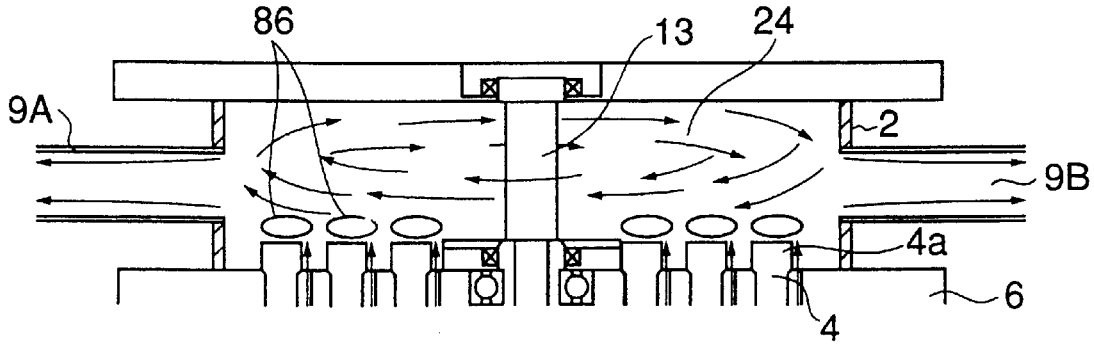
FIG. 14 is a partial longitudinal view showing the construction of the upper header part of an embodiment according to the present invention for preventing the stagnation of ice.

FIG. 14 shows a construction for preventing the stagnation ice in the outlet at the upper part of the ice-making machine 1. As the flow velocity in the upper header is also small, the ice apt to stagnate similarly. By making the head part 4*a* of the rotating rod 4 protrude into the header 24, eddy-like flow 86 is generated by the agitating action of the head part 4*a*, and the ice grains ride on the flow to be prevented from stagnation.

Figure 15:
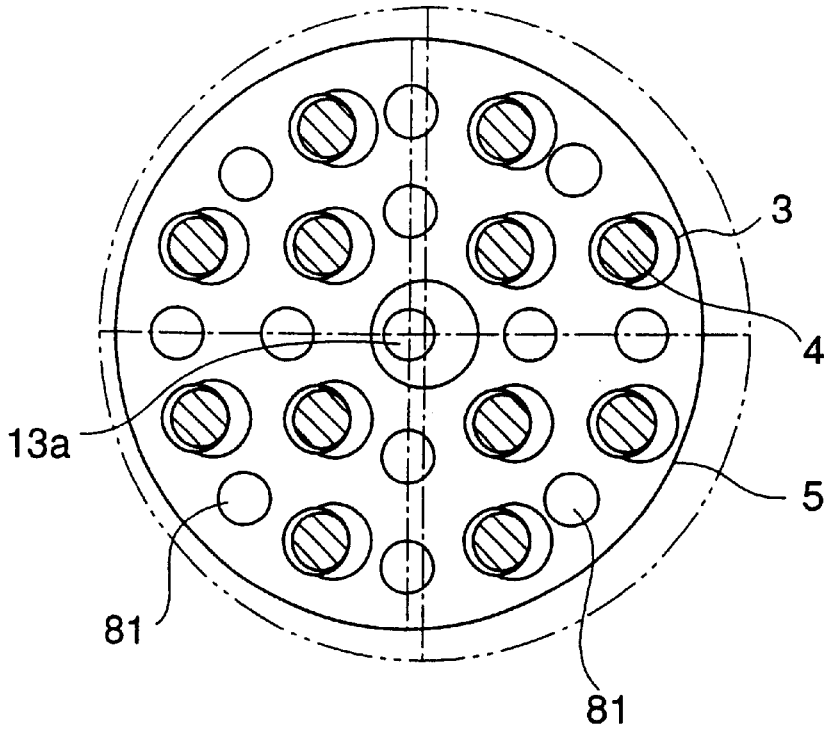
FIG. 15 is a plan view of the driving plate of an embodiment according to the present invention showing additional flow passages for ice slurry.
Figure 16:
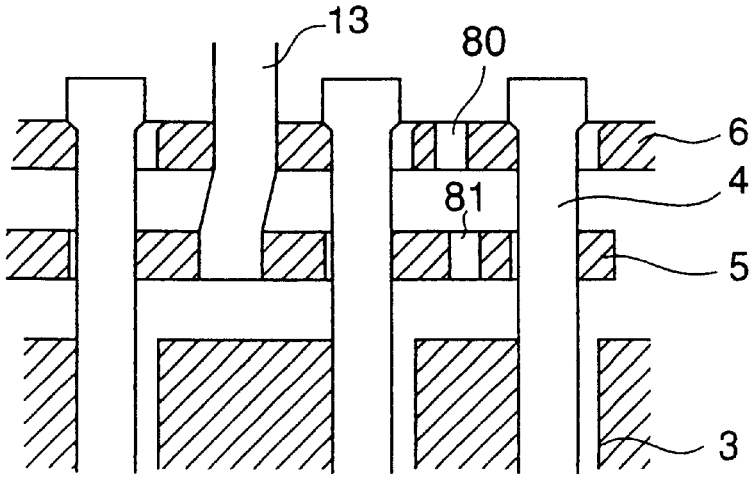
FIG. 16 is a partial longitudinal sectional view of the driving plate and fixed plate of an embodiment according to the present invention showing additional flow passages for ice slurry.

FIG. 15 and FIG. 16 show an example additional flow passages that are provided on the driving plate 5 and the fixed plate 6.

Additional holes 80 and 81 which are additional flow passages for the mixture of liquid to be cooled and ice in addition to the holes for the rotating rods 4. By the additional holes, the stagnation of the ice between both plates is prevented.

As the ice grains generated also flow through the additional holes 80, 81 in addition through crescent holes formed between the holes 5*a* on the driving plate and the rotating rods 4, and crescent holes formed between the holes 6*b* on the fixed plate and the rotating rods 4, biting of ice grains between the rotation sliding contact surfaces is reduced. Therefore, the erosion of the sliding contact faces of the plate 5*a*, 6*b* and the rotating rods 4 is suppressed, at the same time weight reduction is attained.

Figure 17:
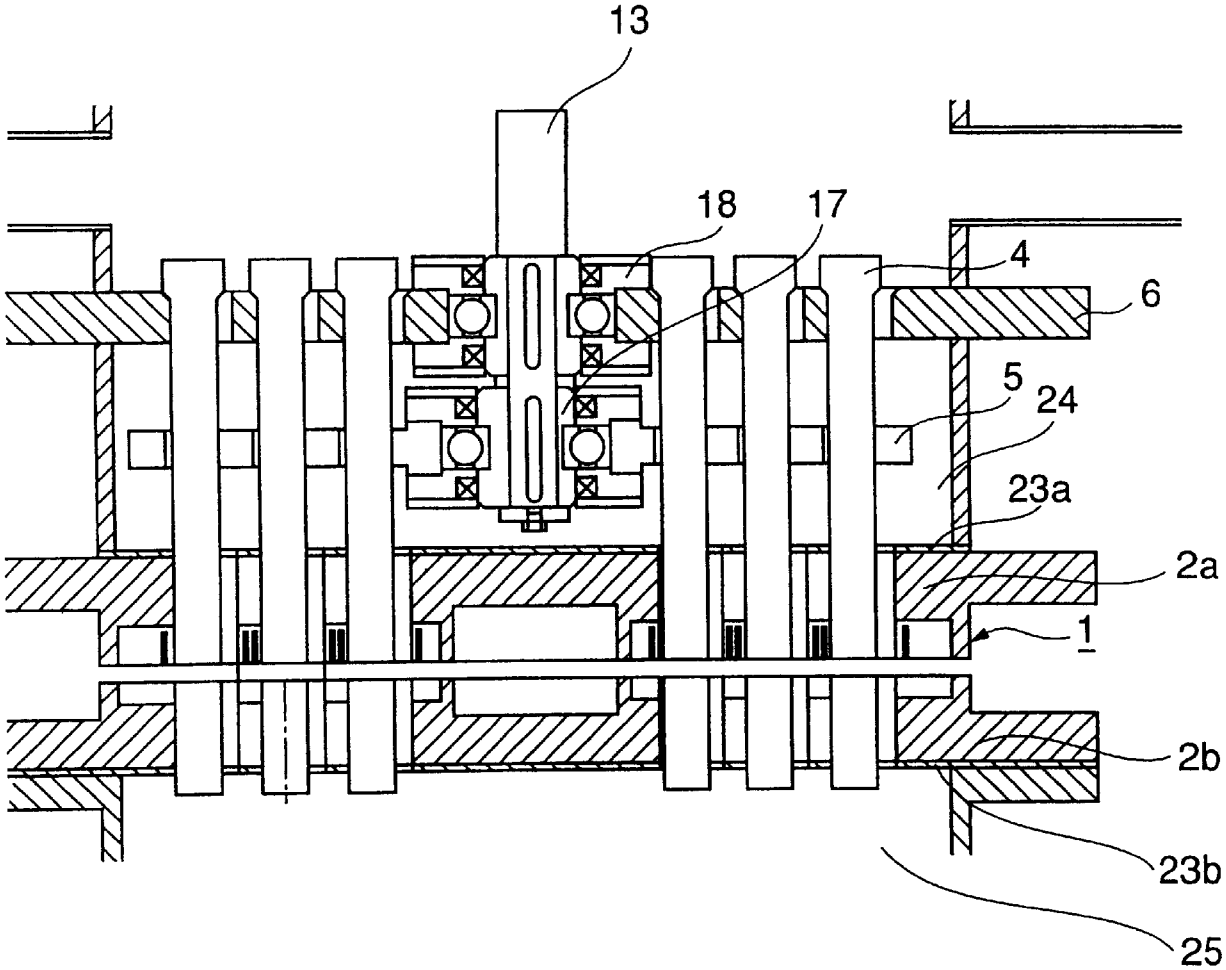
FIG. 17 is a partial longitudinal view of the pipe end plates of an embodiment according to the present invention showing heat insulation configuration.

FIG. 17 shows a configuration for preventing freezing by allowing the pipe end plate 2*a* and 26*b* to be provided with a heat insulating layer 23*a* and 23*b* respectively. The heat insulating layer 23*a* is provided on the upper surface of the pipe end plate 2*a*, and the heat insulating layer 23*b* is provided on the rear surface of the pipe end plate 2*b*. By this construction, the growth of the ice frozen on the pipe endplates 2*a* and 2*b* is prevented from growing in the headers 24 and 25.

If the freezing on the pipe endplates 2*a* and 2*b* proceeds, the ice generated on these portion becomes hard, and there occur such problems that it chokes the passages of the liquid to be cooled or hard ice exfoliated when the ice-making machine 1 is stopped, chokes the piping, etc. The heat insulating layers 23*a*, 23*b* prevent the generation of the hard ice mentioned above.

Figure 18A:
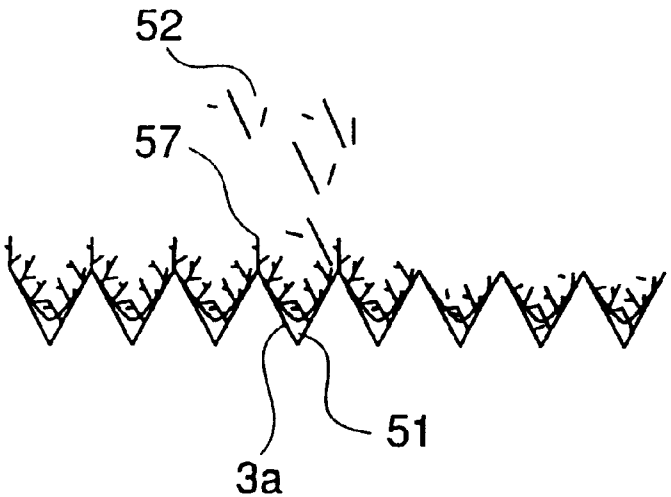
FIG. 18 is an explanatory drawing of the exfoliation of the ice on the inside surface of the heat transfer pipe of an embodiment according to the present invention.
Figure 18B:
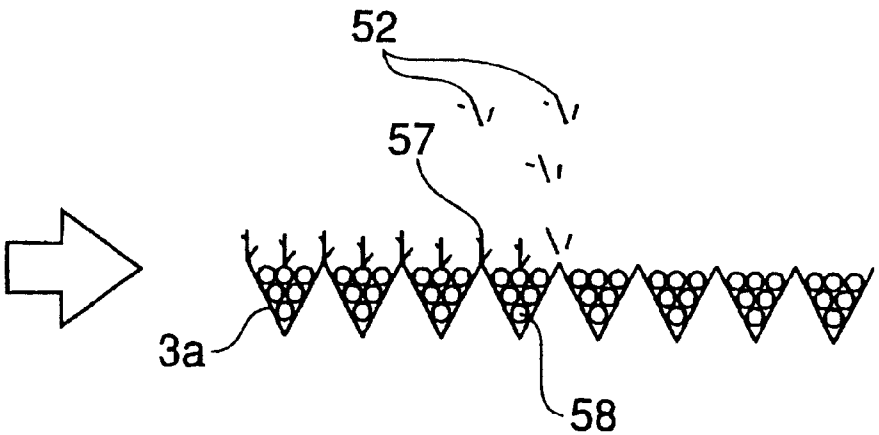

FIG. 18 is a schematic view showing grooves 3*a* formed on the inside surface of the heat transfer pipe 3 for easing exfoliation of ice. As shown in FIG. 18(*a*), grooves 3*a* for making the flaking-off of ice easy are formed on the inside surface of the heat transfer pipe 3. Ice crystal 57 adheres to the grooves in various direction, dense brine layers 51 are formed in the roots of the grooves 3*a*, and the ice becomes easy to be flaked off (52).

If pieces of foreign matter 58 reside in the roots of the grooves 3*a*, the effect the grooves of easing the exfoliation of the ice becomes lost, and heat transfer is deteriorated owing to the resistance of the soil layer to heat transfer.

According to the present invention, as the outer surface of the rotating rod 4 is plastic material, fine pieces of foreign matter are embedded in the plastic, and as the diameter of the rotating rod 4 is large, the flow velocity of the liquid to be cooled inside the heat transfer pipe 3 is large enough to make it difficult for the pieces of foreign matter to reside in the grooves 3*a*. Therefore, the phenomenon as shown in FIG. 18(*b*) can be evaded.

Figure 19:
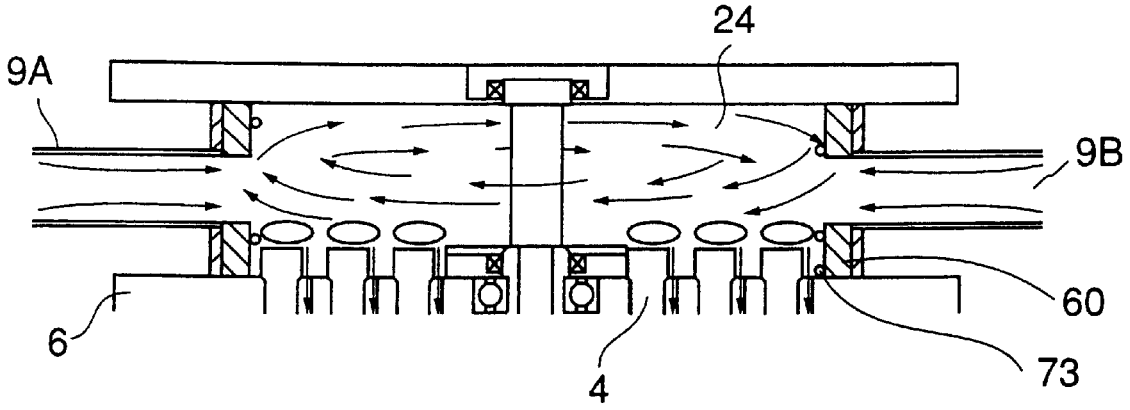
FIG. 19 is a partial longitudinal view showing the configuration of the upper header for removing iron rust according to the present invention.
Figure 20:
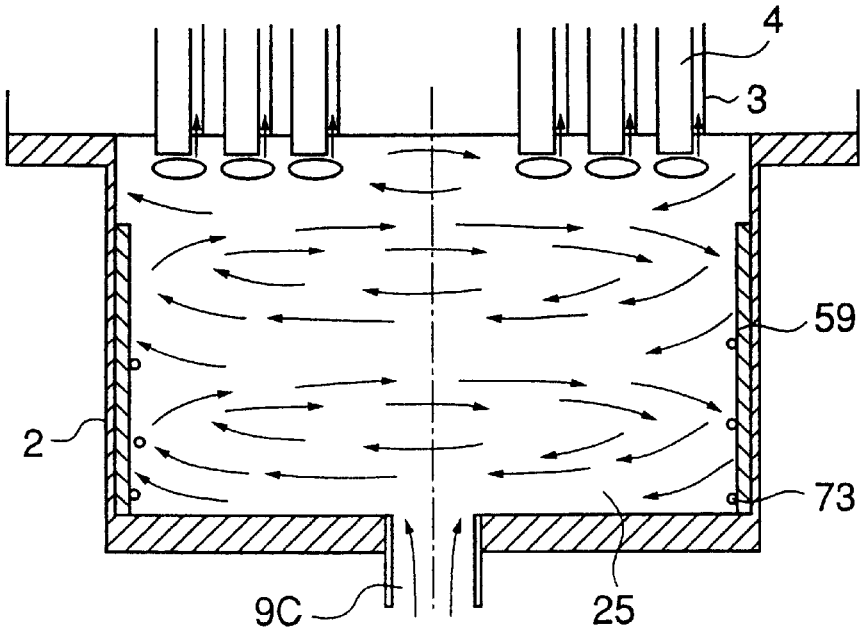
FIG. 20 is a partial longitudinal view showing the construction of the lower header for removing iron rust according to the present invention.

FIGS. 19, 20 are examples of magnets 59 and 60 that are provided on the inside wall faces of the upper header 24 and lower header 25 respectively. By this configuration, pieces of magnetic matter with high specific gravity such as worn-off metal, iron rust etc. contained in the liquid to be cooled agitated in the headers 24 and 25 are gathered by centrifugal force to the inner periphery of the headers to be adhered to the magnets 59 and 60 and removed.

Figure 21:
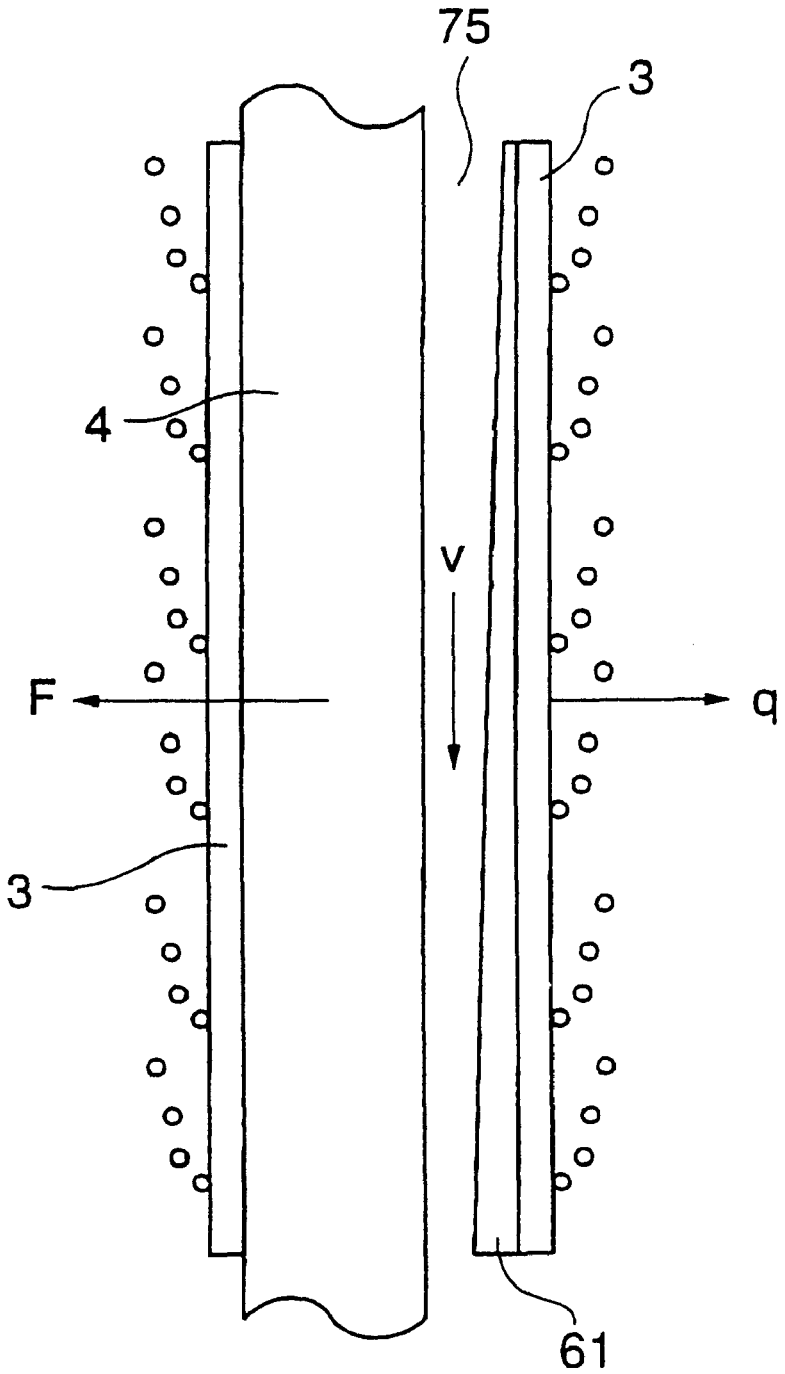
FIG. 21 is an explanatory drawing showing a means for defining the flow rate of the liquid to be cooled according to the present invention.

FIG. 21 is an explanatory drawing of a method for defining the flow rate of the liquid to be cooled.

For example, it is supposed that the heat flux q from the liquid to be cooled 75 is: $q \leqq 12000$ kcal/m$^2$h, centrifugal force F of the rotating rod is: $F \geqq 7.63$ kgf, average velocity v of the liquid to be cooled is: $v \geqq 0.23$ m/s. The average velocity v is adjusted so that the packing rate of ice 61 which increases as the liquid to be cooled flows forward inside the heat transfer pipe 3 is 5% or lower. When the average velocity v of the liquid to be cooled is too low, the difference of the ice packing factor at the outlet and inlet becomes large. Then the resisting force against the rotation of the rotating rod 4 differs too much at the head part and tail part of the rotating rod 4 and the contact of the rod 4 with the heat transfer pipe 3 becomes bad leading to insufficient scraping action. Therefore, it is preferable to keep the ice packing factor equal to or smaller than 5%.

FIG. 22 shows an adjusting mechanism of the amount of eccentricity. A slide cam 90 and an eccentricity adjusting spring 91 are provided at the center part of the driving plate 5. When ice 61 grows to frozen layer 92 inside the heat transfer pipe 3 without being exfoliated, the amount of eccentricity of the driving plate 5 decreases, and as shown in FIG. 22(*b*), the rotating rod 4 moves toward the center side inside the heat transfer pipe 3. Accompanying the movement, the radius of revolution of the driving plate 5 decreases from r to r'.

While a few embodiments of the invention have been illustrated and described in detail, it is particularly understood that invention is not limited thereto or thereby and modifications in design not departing from the scope of concept of the invention is included in the invention.

Figure 2:
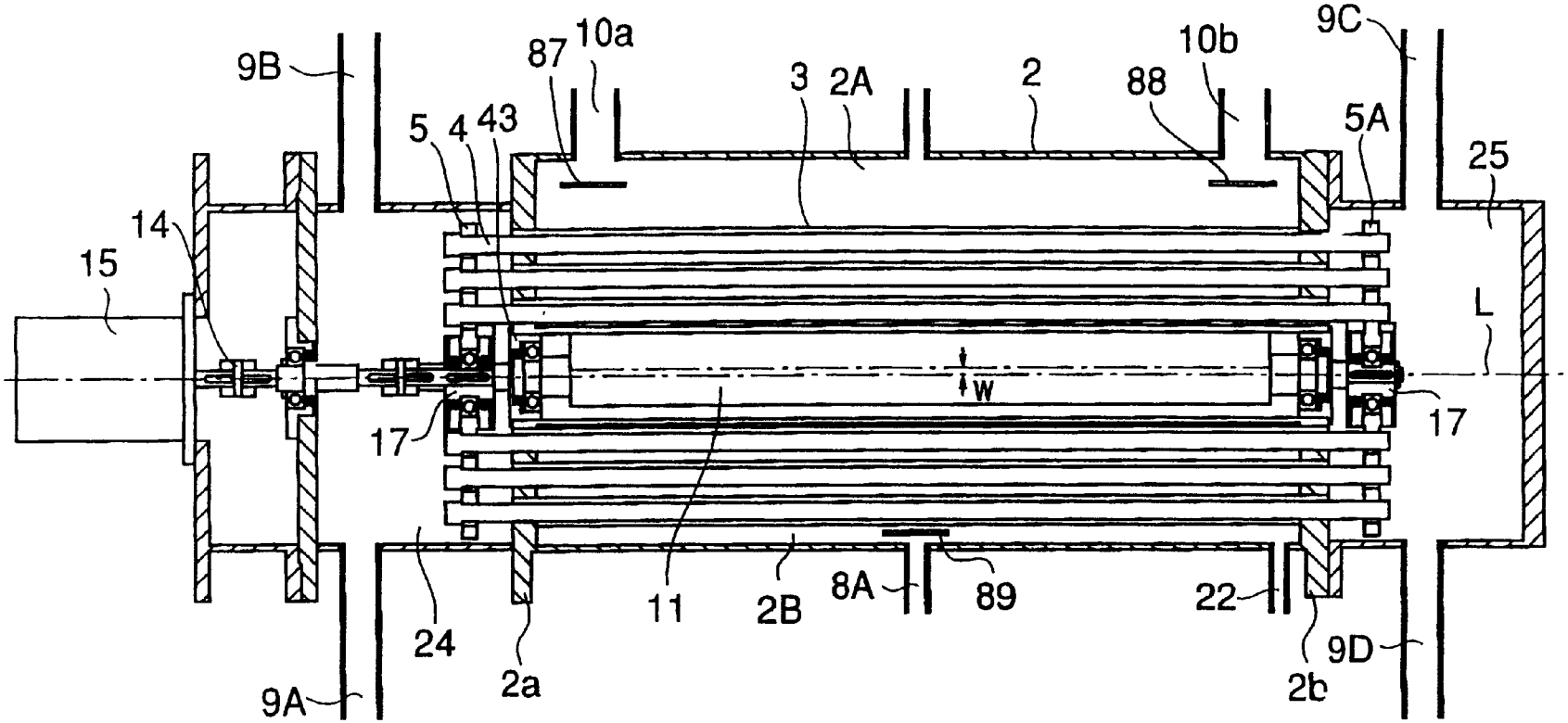
FIG. 2 is a longitudinal sectional view showing a second embodiment of an ice-making machine according to the present invention.

For example, as shown in FIG. 2, a full-filled horizontal ice-making machine is possible to be composed.

While the basic construction is the same as the vertical dry type ice-making machine shown in FIG. 1, it has not fixed plate 6 of FIG. 1, and a driving plate 5A is provided also at the header 25 side end part of the rotating rods 4. In the center zone of the shell 2 (the center zone is dead space 20 in FIG. 1) is disposed a balance weight 11 offset from the center line L by an amount w, the balance weight being supported by the pipe end plates 2*a* and 2*b*, and both ends of the balance weight 11 are connected with driving plate 5 and 5A by the medium of the eccentric cams 17 respectively.

Baffle plates 87, 88, and 89 are provided at the locations inner side from the outlets 10*a*, 10*b* and inner side from the inlet 8A of the refrigerant. In the shell 2 the upper space 2A is large and lower space 2B is small so as to allow the heat transfer pipes 3 to be immersed in the refrigerant. This is for obtaining enough space for the evaporated refrigerant gas to be filled in the shell 2. At the upper and lower side of the header 25 are provided an outlet 9C and inlet 9D for the mixture of the liquid to be cooled and ice to facilitate the discharge of ice gathering toward the upper side and pieces of foreign matter gathering toward the lower side.

As cited above, according to the present invention, a driving shaft drives a driving plate by the medium of a eccentric driving means provided on the driving shaft so as to revolve the driving plate around the center of the driving shaft and rotating rods passing through holes on the driving plate revolve around the center of the driving shaft while rotating. Accordingly, all of the rotating rods are driven synchronized by a single eccentric driving means.

Therefore, an ice-making machine of closed type with a simplified eccentric driving means and a small number of constituent parts is obtained, leading to easy maintenance and operation free from the intrusion of air.

Further, by configuring each of the rotation rods as a metal rod provided with a plastic layer on the surf ace, metal-to metal contact is avoided and worn-off metal grains are embedded in the plastic layer, so less abrasion of the inside surface of the heat transfer pipe is effected.

Still further, by configuring So that the taper face of the head part of the rotating rod sit on the taper face of the hole of the fixed plate to slide on it, friction face of rotation becomes small and deformation and damage due to wear can be reduced.

Yet further, by the ice-making method according to the above cited invention, the driving motor is started with low rotation speed at first when the evaporating temperature of the refrigerant is 0° C. or below and the rotation speed of the driving motor is increased at the time the freezing in the heat transfer pipes has advanced, so the plastic layers formed on the surface of the rotating rods are prevented from melting in the early stages of the operation when the temperature of the rotating rods is high, owing to the low speed of the rotation, and the supply of the refrigerant and the liquid to be cooled can be controlled. Therefore, ice grains are produced by automatic and safe operation.

What is claimed is:

1. An ice-making machine provided with a plurality of heat transfer pipes and rotating rods, each of the rods rotating in each of the heat transfer pipes which are disposed inside a shell, a liquid to be cooled being supplied inside the heat transfer pipes and a refrigerant liquid being supplied outside the heat transfer pipes, wherein ice crystals are formed on inside surfaces of the heat transfer pipes through cooling of the liquid to be cooled, and the ice crystals are scraped off with the rotating rods and taken out together with the liquid to be cooled, wherein the rotating rods which pass through holes, the holes being larger in diameter than the rotating rods, of a driving plate connected with a revolving eccentric driver provided on a driving shaft, revolve while rotating in the heat transfer pipes, and wherein a slide cam for adjusting an amount of eccentricity is provided between the driving plate and the driving shaft.

2. An ice-making machine according to claim 1, wherein the eccentric driver is an eccentric cam or a crank.

3. An ice-making machine according to claim 1, wherein each of the rotating rods is a metal rod provided with a plastic layer on the surface.

4. An ice-making machine according to claim 1, wherein insulating material is attached on each end face of pipe end plates provided on both ends of the shell.

5. An ice-making machine according to claim 1, wherein each of the rotating rods is supported at a head part formed at an upper end by a fixed plate attached to the shell, a taper face formed on a lower periphery of the head part of each of the rotating rods sitting on a taper face formed on a periphery of corresponding holes on the fixed plate.

6. An ice-making machine according to claim 1, wherein each of the rotating rods is supported at a head part formed at an upper end by a fixed plate attached to the shell, wherein a taper face formed on a lower periphery of the head part of each of the rotating rods sits on a taper face formed on a periphery of corresponding holes on the fixed plate, and wherein additional holes through which a mixture of the liquid to be cooled and ice flows are formed on the driving plate and the fixed plate.

7. An ice-making machine according to claim 1, wherein the shell is disposed horizontally, both ends of the rotating rods being supported by the driving plates at each end side, and wherein a balance weight driven by the drive shaft is disposed in a center zone of the shell, the heat transfer pipes being immersed in the refrigerant liquid which is filled in the shell.

8. An ice-making machine provided with a plurality of heat transfer pipes and rotating rods, each of the rods rotating in each of the heat transfer pipes which are disposed inside a shell, a liquid to be cooled being supplied inside the heat transfer pipes and a refrigerant liquid being supplied outside the heat transfer pipes, wherein ice crystals are formed on inside surfaces of the heat transfer pipes through cooling of the liquid to be cooled, and the ice crystals are scraped off with the rotating rods and taken out together with the liquid to be cooled, wherein the rotating rods which pass through holes, the holes being larger in diameter than the rotating rods, of a driving plate connected with a revolving eccentric driver provided on a driving shaft, revolve while rotating in the heat transfer pipes, wherein a head part and lower end part of each of the rotating rods protrude into headers disposed at both end sides where the liquid to be cooled passes through, wherein the liquid to be cooled is agitated by revolving motion of the head part and lower end part of each of the rotating rods, and wherein magnets are attached on an inside periphery of the headers.

* * * * *